US005609340A

United States Patent [19]

Chuang

[11] Patent Number: 5,609,340

[45] Date of Patent: Mar. 11, 1997

[54] TOY SET OF FISHING PLAY

[76] Inventor: Chuan-Tien Chuang, No. 40, Lane 174, Da-Shing Street, Tainan, Taiwan

[21] Appl. No.: 599,366

[22] Filed: Mar. 11, 1996

[51] Int. Cl.[6] ..... A63F 9/00

[52] U.S. Cl. ..... 273/448; 446/330; 446/356; 446/353

[58] Field of Search ..... 273/448, 447, 273/140; 446/330, 345, 353, 356, 354, 368; 40/411, 414, 416, 421, 418, 423

[56] References Cited

U.S. PATENT DOCUMENTS 3,353,296 11/1967 Ryan et al. ..... 446/353 X 4,790,532 12/1988 Chen ..... 273/140 X 5,009,418 4/1991 Chuang-Tien ..... 273/448

FOREIGN PATENT DOCUMENTS 2037172 7/1980 United Kingdom ..... 446/353

*Primary Examiner*—Paul E. Shapiro

*Attorney, Agent, or Firm*—Bacon & Thomas

[57] ABSTRACT

A toy set for fishing play mainly includes a casing having an animal contour, inside which there is arranged a driving mechanism and a plurality of toothed rotary trays. The driving mechanism drives various gear sets, which are linked with eyeballs and limbs of the fake animal. As a result, the toy set can imitate a variety of gestures of the animal while fishing play is going on, showing great fun.

3 Claims, 5 Drawing Sheets

TOY SET OF FISHING PLAY

BACKGROUND OF THE INVENTION

1. Field of the Invention

The invention is to provide a toy set of fishing play, especially a toy set that uses links and gear sets to drive parts having the forms of an animal's eyeballs and limbs so as to imitate the animal's consecutive swinging movements, heightening an effect of entertainment and amusement.

2. Brief Description of the Prior Art

A typical fishing toy includes a rotary tray on which there are provided with a plurality of cavities each with a fake fish dwelled there. A metal block is positioned inside each fake fish's mouth. These fake fishes in turn open their mouths as the rotary tray revolves. Participants of fishing play can manipulate a string with a small magnet attached to its end to attract the metal block so as to draw the fish out of the cavity. Along with the game going on, fake fishes open their mouths in a sequence of one after the other. Participants must toss the magnet on the end of the string into the fish's mouth during a short period of the time that the mouth is open, or they cannot get points and win in the fishing play.

Such a fishing toy that has dynamic variation and needs some skills to play with has been welcome by people, especially by children. However, those traditional toys either having a single tray or having a plurality of trays are designed to have a stationary casing, as a consequence of which it does not have an effect of heightening fun in play. As to a toy that intends to provide people with enjoyment to the greatest extent, it is evidently a shortcoming.

In view of the above deficiency, the inventor has worked out a new toy of which the structure can offer greatest pleasure in visual effect beside providing a very interesting fishing game.

SUMMARY OF THE INVENTION

The primary object of the invention is to provide a toy set of fishing play that has a novel structure and that can produce an impressive amusement effect. According to the invention, the toy set incorporates the movements of an animal into play provided by a driving mechanism and rotary trays thereof. Therefore, children can enjoy an animal's various gestures while they play with the toy set. In the embodiment exemplified in the following description, the toy set integrates the movements of a frog's eyeballs and limbs with fishing play and thus gives the toy set of fishing play a brand-new feature, providing much greater fun.

To accomplish the above object the invention mainly comprises a casing inside which there are disposed a driving mechanism and a plurality of toothed rotary trays. The casing consists of an upper half and a lower half having an animal contour and a plurality of movable limb-shaped parts. Each limb-shaped part is composed of a shell and a link. The link is provided with a projecting pin. Furthermore, on the inner surface of the upper half there are arranged a plurality of equidistantly spaced toothed rotary trays for fishing play. The driving mechanism drives various gear sets, to which links of the limb-shaped parts are attached via connecting rods, to imitate the movements of the animal's eyeballs and limbs.

A motor situated on the inner surface of the upper half is used to drive a worm of a driving mechanism. The driving mechanism drives a first driving gear of a first gear set, which causes to rotate a first driven gear that is engaged with the first driving gear. Consequently, a first eccentric pin disposed on the side face of the second driven gear forces a first connecting rod to move. The first connecting rod further actuates the eyeball moving mechanism to move two eyeballs up and down. The first driven gear of the first gear set also urges the first rotary tray, which in turn motivates a second driving gear of the second gear set and a central gear both of which are in engagement with the first rotary tray. Furthermore, along with the rotation of the second driving gear, a second driven gear impels the first upper limb-shaped part and the first lower limb-shaped part to sway by using an eccentric pin, which is arranged on the side face of the second driven gear, to drag the second and the third connecting rod. At the same time the central gear concurrently drives a plurality of toothed rotary trays, of which the second rotary tray rotates a third driving gear (61) of a third gear set. The rotation of the third driving gear causes a third driven gear to move, which is engaged with the third driving gear. Similarly the third driven gear also uses an eccentric pin, which is arranged on the side face of the third driven gear, to set the fourth and the fifth connecting rod in motion, causing the second upper and the second lower limb-shaped part to sway. In addition, a press plate (64) is used to hold the second driving gear (56), the third driving gear (61), and the central gear (59).

The detailed structure, operations, applied principles and other advantages of this invention will become apparent from the following detailed description of a preferred embodiment when read with reference to the accompanying drawings.

DETAILED DESCRIPTION OF PREFERRED EMBODIMENTS

Figure 1:
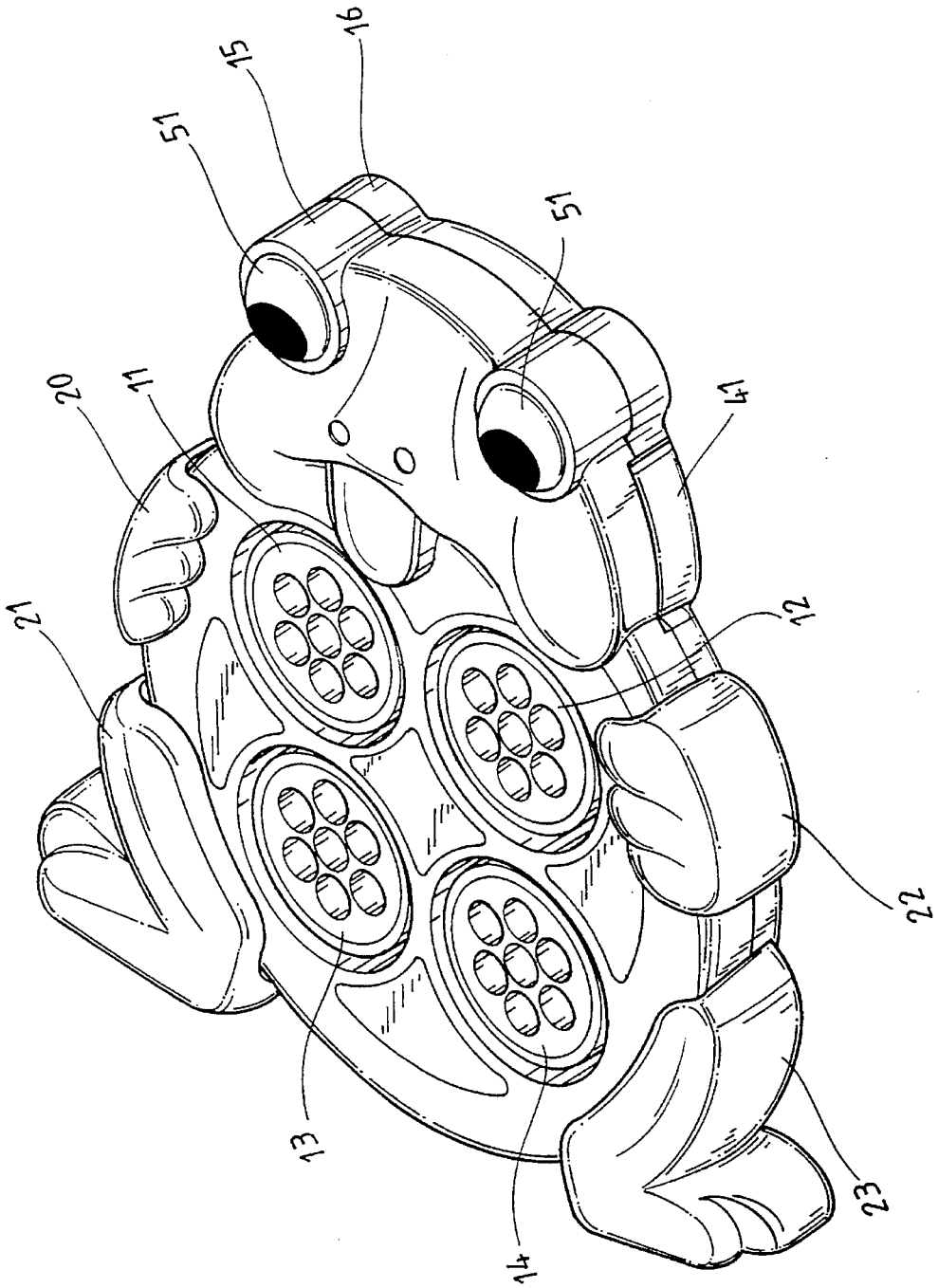
FIG. 1 is a perspective view showing an embodiment of the toy set of the invention, in which fishing rods and fake fishes have been removed.
Figure 2:
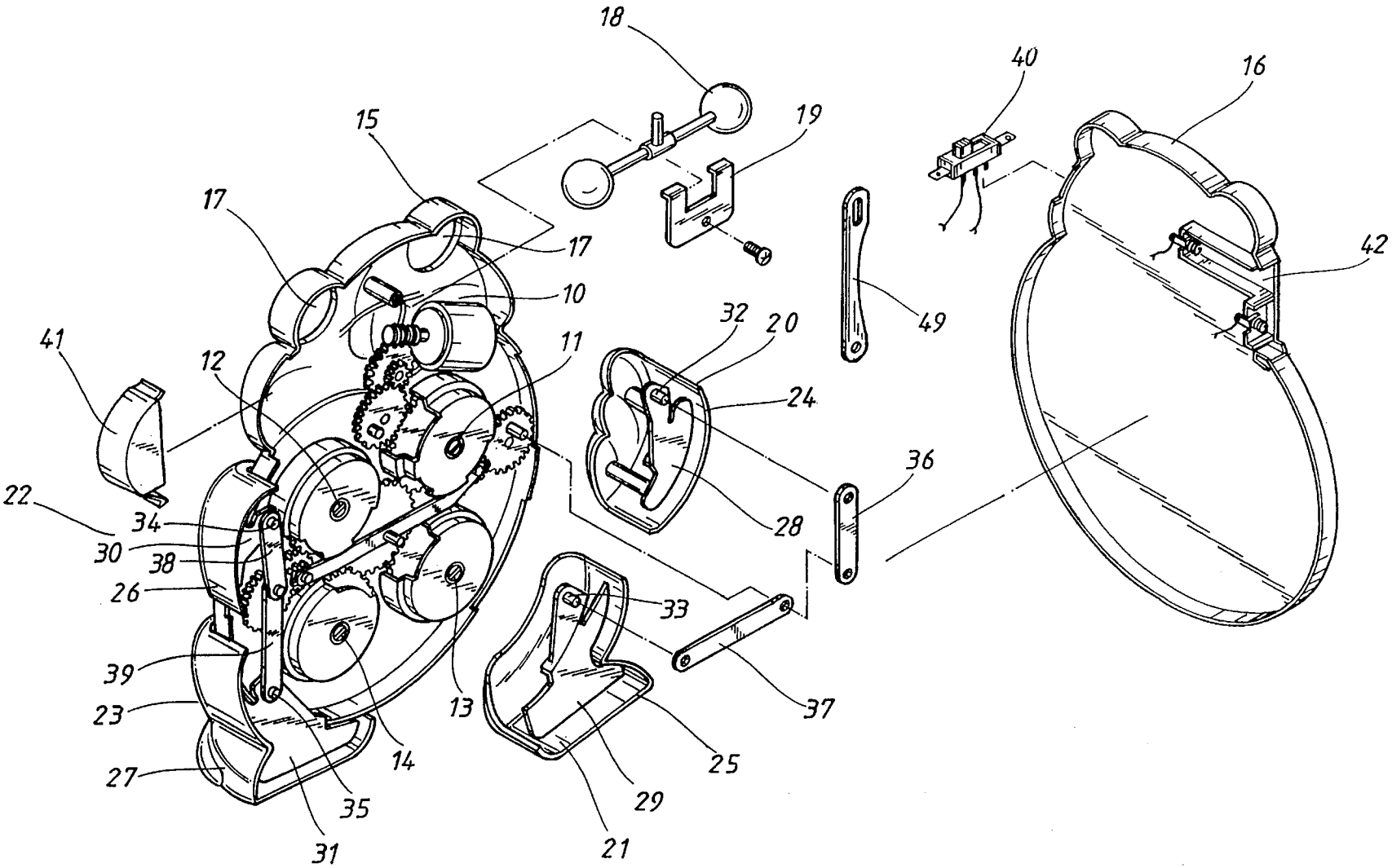
FIG. 2 is an exploded view of the toy set shown in FIG. 1.

As can be seen from FIGS. 1 and 2, a toy set according to the invention includes a casing inside which there are disposed a driving mechanism (10) and a plurality of toothed rotary trays (11), (12), (13), and (14). The casing consists of an upper half (15) and a lower half (16) which are formed in an animal form. In the illustrative embodiment shown in the accompanying drawings the casing shows a frog in its outer appearance and the periphery of the casing is shaped like a frog's head and limbs. The frog head portion formed on the upper half (15) is provided with two eye sockets (17), behind which an eyeball moving mechanism (18) and a U-shaped plate (19) are secured. Furthermore, a plurality of movable limb-shaped parts (20), (21), (22), and (23) are arranged on the frog body portion, each of limb-shaped parts being composed of an outer shell (24), (25), (26), (27) and a link (28), (29), (30), (31). Each link (28), (29), (30), (31) is further furnished with a projecting pin (32), (33), (34), (35) to which a connecting rod (36), (37), (38), (39) is attached. On the inner surface of the upper half (15) there are four equidistantly spaced toothed rotary trays (11), (12), (13), and (14) that are used for fishing play. Additionally, a switch (40) and a battery compartment (42) with a cover (41) are respectively formed on two opposed sides of lower half (16).

Figure 3:
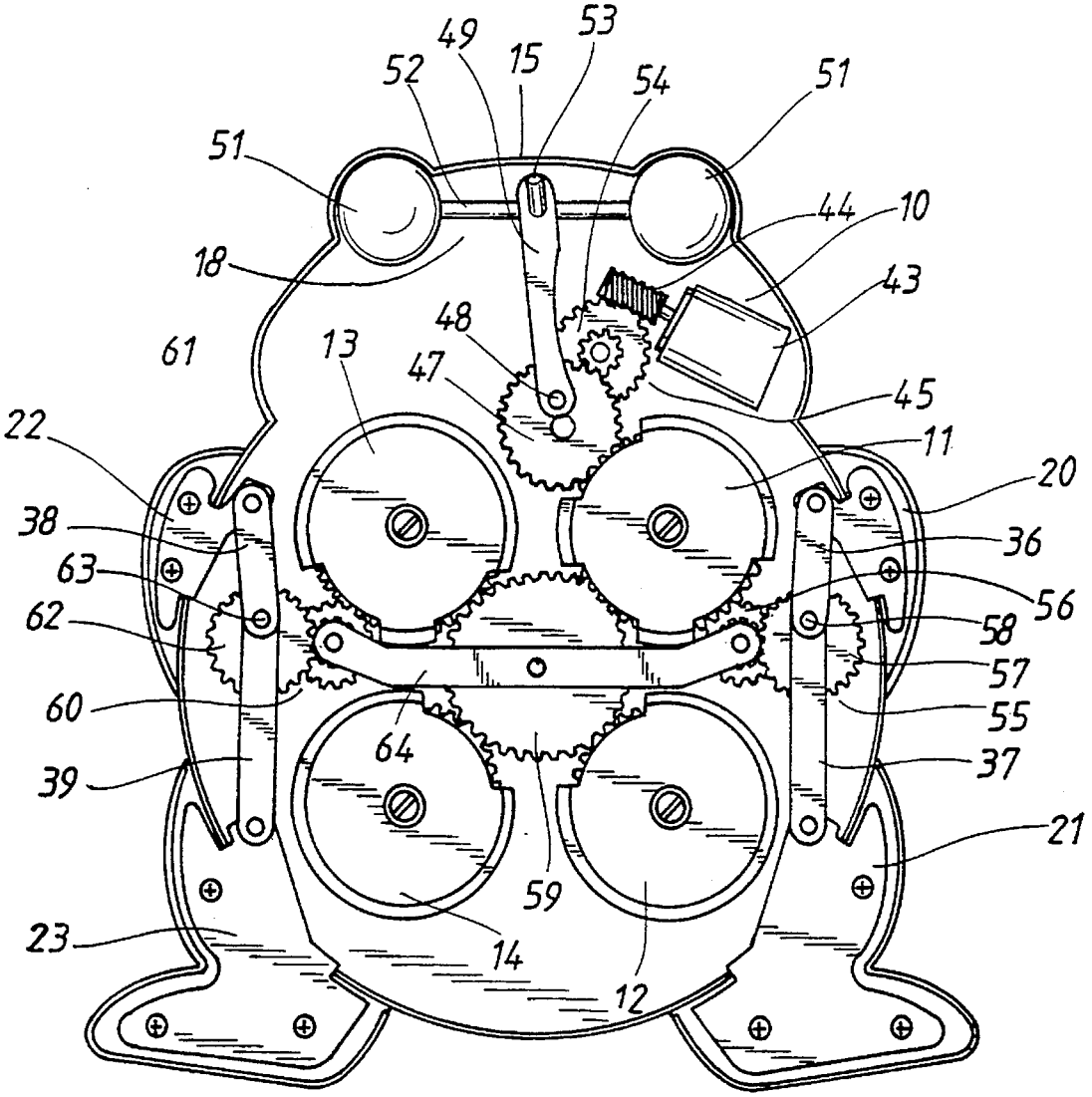
FIGS. 3 and 4 are schematic plan views showing the operation of the toy set shown in FIG. 1.
Figure 4:
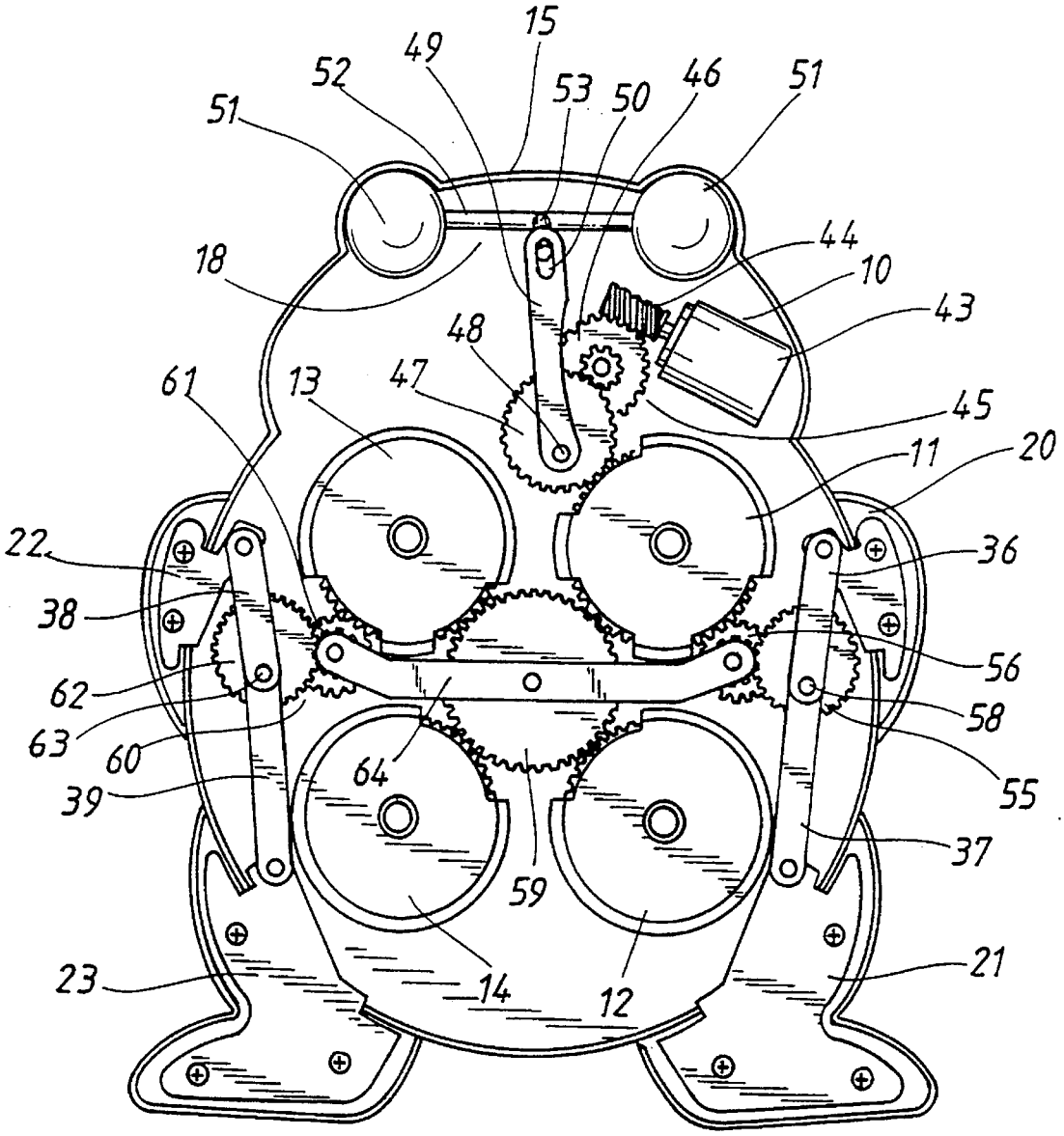

Referring now to FIGS. 3 and 4, these drawings illustrate the operation of the toy set of the invention. A motor (43) situated on the inner surface of the upper half (15) is used to drive a worm (44) of a driving mechanism (10). The driving mechanism (10) further drives a first driving gear (46) of a first gear set (45), which causes to rotate a first driven gear (47) that is engaged with the first driving gear (46). Consequently, a first eccentric pin (48) disposed on the side face of the second driven gear (47) forces a first connecting rod (49) to move. The first connecting rod (49) has one end pivotally attached to the first eccentric pin (48) and the other end connected to the eyeball moving mechanism (18) by means of an elongated hole (50), which is formed on the first connecting rod and fitted over a projecting pin (53), the projecting pin (53) being situated at the central point of a crossbar (52) of the eyeball moving mechanism (18) and two fake eyeballs being affixed to two opposed ends of the crossbar (52). With such an arrangement, the motion of eyeballs can be spurred by the first connecting rod (49). Additionally an arcuated recessed portion (54) is formed on one side edge of the first connecting rod (49) near the first driving gear (46) to prevent the connecting rod (49) from possible interference with the gear when the toy set is in operation. The first driven gear (47) of the first gear set (45) further urges the first rotary tray (11), which in turn motivates a second driving gear (56) of the second gear set (55) and a central gear (59) both of which are in engagement with the first rotary tray. Furthermore, along with the rotation of the second driving gear (56), a second driven gear (57) impels the first upper limb-shaped part (20) and the first lower limb-shaped part (21) to sway by using an eccentric pin (58), which is arranged on the side face of the second driven gear (57), to drag the second and the third connecting rod (36), (37). At the same time the central gear (59) concurrently drives the other three toothed rotary trays (12), (13), and (14), of which the second rotary tray (12) rotates a third driving gear (61) of a third gear set (60). The rotation of the third driving gear (61) causes a third driven gear (62) to move, which is engaged with the third driving gear (61). Similarly the third driven gear (62) also uses an eccentric pin (63), which is arranged on the side face of the third driven gear (62), to set the fourth and the fifth connecting rod (38), (39) in motion, causing the second upper and the second lower limb-shaped part (22), (23) to sway. In addition, a press plate (64) is used to hold the second driving gear (56), the third driving gear (61), and the central gear (59). In this way, the toy set of the invention can be operated by the power delivered through a driving mechanism (10) to limb-shaped parts and eyeballs. Evidently the number of the rotary trays of the toy set of the invention can be one or more depending on the requirement.

FIG. 3 illustrates that the movable parts of the toy set such as eyeballs (51) and four limb-shaped parts (20), (21), (22), and (23) are urged to sway by means of an arrangement of gears and links. FIG. 4 shows that the eyeballs (51) are moved upwardly and four limb-shaped parts (20), (21), (22), and (23) retract inwardly. These movements can be varied by means of many combinations of a variety of angular travels of gears.

Figure 5:
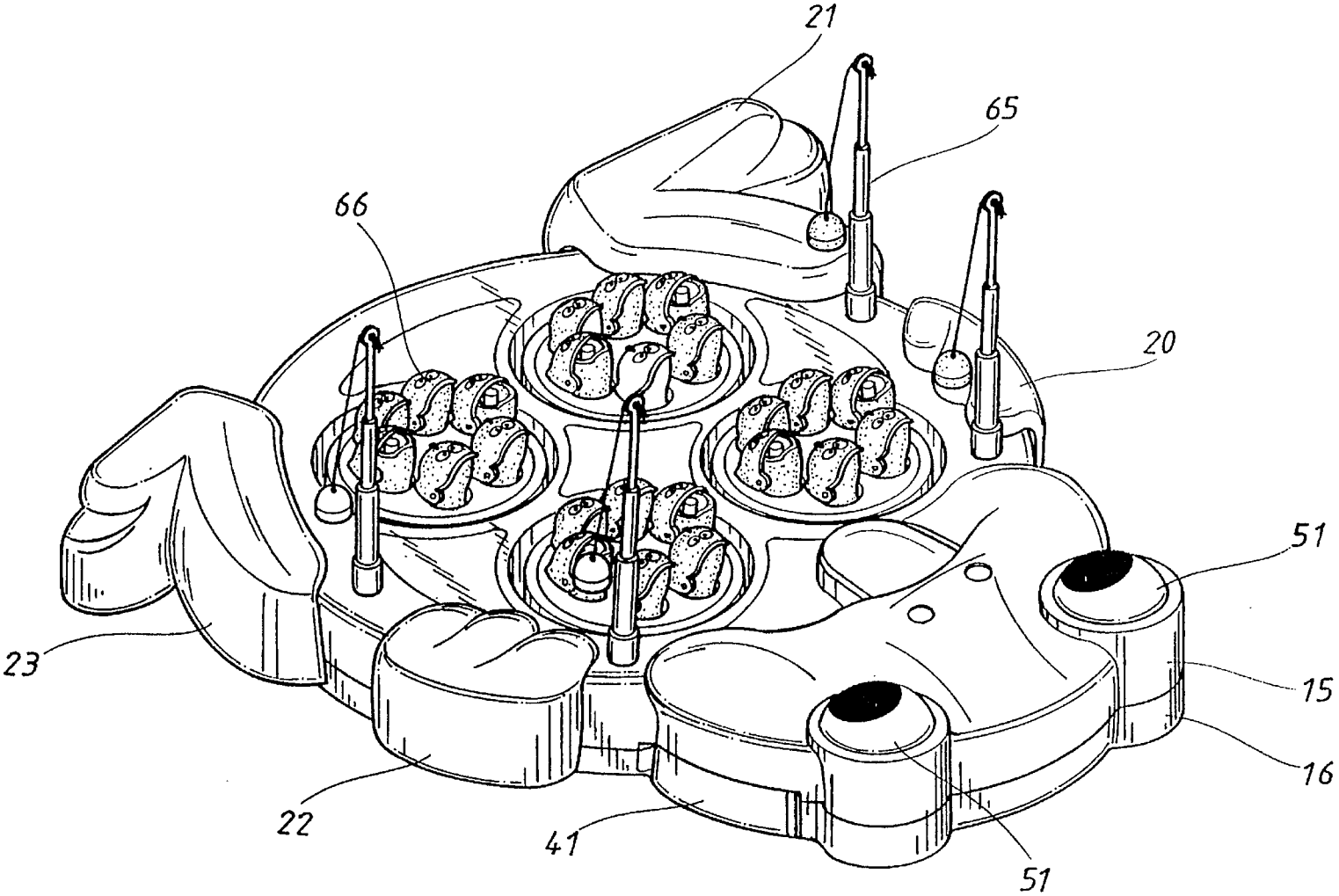
FIG. 5 is a perspective view showing the outer appearance of a complete toy set in which fishing rods and fake fishes are arranged in position.

As described above, the invention has disclosed a novel fishing toy. Referring now to FIG. 5, it illustrates an embodiment of the invention, in which fishing rods (65) and fake fishes (66) have been placed in position. According to the invention, the toy makes use of a driving mechanism and toothed rotary trays in cooperation with links and gear arrangements to create simulated movements of an animal's limbs, which, accompanied by interesting fishing play, produce unique attractiveness and superior marketing competitive ability. Evidently the invention is of practical value in industry.

What is claimed is:

1. A toy set of fishing play mainly comprising a casing inside which there is arranged a driving mechanism and a plurality of toothed rotary trays for fishing play, wherein said driving mechanism drives gear sets to activate an eyeball moving mechanism and limb moving mechanisms via connecting rods;

said casing having an animal's form and containing a motor that is used to drive a worm of said driving mechanism;

said driving mechanism delivering the power of said motor to a driving gear of a first gear set so that a driven gear, engaged with said driving gear, uses an eccentric pin to spur a connecting rod to move up and down eyeballs affixed to said eyeball moving mechanism;

said driven gear of said first gear set further rotating a first toothed rotary tray, which causes a driving gear of a second gear set and a central gear to turn so that an eccentric pin of a driven gear of said second gear set pushes the first limb-shaped parts to sway;

said central gear concurrently driving a plurality of toothed rotary trays to operate, of which a second rotary tray also turns a driving gear of a third gear set so that an eccentric pin on the driven gear of said third gear set sets the second limb-shaped parts in motion.

2. A toy set as claimed in claim 1, in which said casing consists of an upper half and a lower half having a frog's form, and a plurality of movable limb-shaped parts;

said upper half being provided with two eye sockets behind which eyeballs with the moving means are secured therein by a U-shaped plate;

said limb-shaped parts being respectively composed of a shell and a link with a projecting pin arranged thereon for a connection with said connecting rods;

said lower half having a switch arranged on one side near the head portion of the frog-shaped casing half and a battery compartment with a cover formed on the opposed side.

3. A toy set as claimed in claim 1, in which the number of said toothed rotary trays can be one or more.

* * * * *